US008907241B2

(12) United States Patent
Dell'Endice et al.

(10) Patent No.: US 8,907,241 B2
(45) Date of Patent: Dec. 9, 2014

(54) SORTING APPARATUS

(75) Inventors: Francesco Dell'Endice, Zürich (CH); Paolo D'Alcini, Zürich (CH)

(73) Assignee: QualySense AG, Dubendorf (CH)

( * ) Notice: Subject to any disclaimer, the term of this patent is extended or adjusted under 35 U.S.C. 154(b) by 0 days.

(21) Appl. No.: 13/822,769

(22) PCT Filed: Feb. 2, 2012

(86) PCT No.: PCT/CH2012/000027

§ 371 (c)(1),
(2), (4) Date: Mar. 13, 2013

(87) PCT Pub. No.: WO2012/145850

PCT Pub. Date: Nov. 1, 2012

(65) Prior Publication Data

US 2013/0168301 A1 Jul. 4, 2013

(30) Foreign Application Priority Data

Apr. 28, 2011 (CH) ..... 723/11

(51) Int. Cl.

| | |
|---|---|
| ***B07C 5/00*** | (2006.01) |
| ***B07C 5/342*** | (2006.01) |
| ***B07C 5/02*** | (2006.01) |
| ***B07C 5/36*** | (2006.01) |

(52) U.S. Cl.

CPC . *B07C 5/342* (2013.01); *B07C 5/02* (2013.01); *B07C 5/368* (2013.01)

USPC ..... 209/588; 209/576

(58) Field of Classification Search

USPC ..... 209/44.2, 552, 576, 587, 588, 644, 905, 209/932; 198/471.1, 689.1

See application file for complete search history.

(56) References Cited

U.S. PATENT DOCUMENTS 3,757,943 A * 9/1973 Chae et al. ..... 209/551
4,026,437 A 5/1977 Biddle (Continued)

FOREIGN PATENT DOCUMENTS

CN 1200807 A 12/1998
CN 1672814 A 9/2005

(Continued)

OTHER PUBLICATIONS

International Search Report for PCT/CH2012/000027 dated Apr. 3, 2012.

(Continued)

*Primary Examiner* — Joseph C Rodriguez
(74) *Attorney, Agent, or Firm* — Sughrue Mion, PLLC

(57) ABSTRACT

An apparatus and a method for sorting particles into quality classes are disclosed. The apparatus comprises a measurement device (400) for determining at least one analytical property of said particles. A transport device (300) transports the particles past the measurement device. A sorting device (500) is operatively coupled to the measurement device and sorts the particles into at least two quality classes based on the analytical property. To achieve rapid and reliable transport, the transport device comprises a transport surface (310) configured to move in a transport direction. The transport surface has a plurality of perforations. The transport device further comprises a pump (130) for applying a pressure differential to these perforations, to cause particles fed to the transport device to be aspirated to the perforations and to be transported on the transport surface past the measurement device to the sorting device. In preferred embodiments, the transport surface is implemented as an endless transport belt or as a transport drum.

29 Claims, 11 Drawing Sheets

(56) References Cited

U.S. PATENT DOCUMENTS

| | | | | |
|---|---|---|---|---|
| 4,582,201 | A * | 4/1986 | Taniguchi et al. | 209/587 |
| 4,699,273 | A | 10/1987 | Suggi-Liverani et al. | |
| 4,946,046 | A * | 8/1990 | Affleck et al. | 209/580 |
| 4,975,863 | A | 12/1990 | Sistler et al. | |
| 5,040,353 | A | 8/1991 | Evans et al. | |
| 5,379,949 | A | 1/1995 | Massen et al. | |
| 5,501,366 | A | 3/1996 | Fiorido | |
| 5,524,746 | A * | 6/1996 | Massen et al. | 198/443 |
| 5,750,979 | A * | 5/1998 | Yamamoto et al. | 250/223 R |
| 5,956,413 | A | 9/1999 | Öste et al. | |
| 6,013,887 | A | 1/2000 | Satake et al. | |
| 6,078,018 | A | 6/2000 | Davis et al. | |
| 6,114,636 | A | 9/2000 | Cane'et al. | |
| 6,732,498 | B2 * | 5/2004 | Keen et al. | 53/567 |
| 7,012,242 | B2 * | 3/2006 | Tarozzi et al. | 250/222.1 |
| 7,417,203 | B2 | 8/2008 | Löfquist et al. | |
| 7,484,624 | B2 * | 2/2009 | Saika | 209/307 |
| 8,072,590 | B2 * | 12/2011 | Ackley et al. | 356/237.1 |
| 2005/0211256 | A1 | 9/2005 | Funke et al. | |
| 2006/0096894 | A1 | 5/2006 | Brandner et al. | |

FOREIGN PATENT DOCUMENTS

| | | | |
|---|---|---|---|
| DE | 10 140 773 | A1 | 3/2002 |
| EP | 0475121 | A2 | 3/1992 |
| EP | 0 598 636 | A2 | 5/1994 |
| EP | 1 704 762 | A1 | 9/2006 |
| FR | 2 291 927 | A | 6/1976 |
| GB | 1528236 | A | 10/1978 |
| JP | 231872 | A | 2/1990 |
| JP | 200528285 | A | 2/2005 |
| WO | 2006/054154 | A1 | 5/2006 |

OTHER PUBLICATIONS

Communication dated Jul. 22, 2014, from the State Intellectual Property Office of the People's Republic of China in counterpart Chinese Application No. 201280020714.8.

* cited by examiner

SORTING APPARATUS

CROSS REFERENCE TO RELATED APPLICATIONS

This application is a National Stage of International Application No. PCT/CH2012/000027 filed Feb. 2, 2012, claiming priority based on Swiss Patent Application No. 00723/11 filed Apr. 28, 2011, the contents of all of which are incorporated herein by reference in their entirety.

TECHNICAL FIELD

The present invention relates to an apparatus and a method for real-time, non-invasive, and non-destructive analysis and sorting of particles of mixed analytical properties, such as seeds, grains, kernels, beans, beads, pills, plastic particles, mineral particles, or any other granular material into two or more quality classes. A quality class contains particles of similar analytical properties, which may include physical properties, chemical properties, biochemical properties, or the degree of contamination with contaminating agents or infective agents. The particles may be of agricultural origin, as in the case of seed, grains and kernels, or of any other origin.

PRIOR ART

Many systems have been suggested in the prior art for sorting granular material according to various criteria such as size, shape, color, presence or absence of certain materials, or organic properties such as moisture, density or protein content. To this end, it is known to transport the particles past a measuring setup which takes images of the particles and/or measures spectral properties of the particles in the IR, visible or UV regions of the electromagnetic spectrum.

Various means for transporting the particles past the measuring setup have been suggested. In particular, a variety of arrangements have been suggested wherein the particles slide down an inclined chute or are transported by a conveyor belt to a measurement region, which is traversed by the particles in free fall. Particles are sorted by deflecting selected particles into a separate container by an air stream from a compressed-air nozzle. Examples include U.S. Pat. Nos. 6,078,018, 6,013,887 and 4,699,273. In such arrangements, the process of handling the particles during sorting is not controlled, and it is therefore difficult to properly synchronize the measurement step and the sorting step, which may cause particles that should be deflected to be missed by the air stream or may cause the wrong particles to be deflected. A further disadvantage of such arrangements is that the orientation and exact trajectory of the particles during the measurement step is indeterminate. Furthermore, such setups offer only very limited flexibility with respect to the measurement conditions; just by the way of example, once a certain setup has been chosen, this setup will determine the speed of the particles traversing the measurement region and therefore the maximum integration time of the detector. This is disadvantageous if the analytical property that is to be determined shall be changed, since different analytical properties may require different integration times of the detector. Another disadvantage is that such arrangements sort particles generally only into two quality classes, and modifications to sort into more than two quality classes are difficult to implement or even impossible.

U.S. Pat. No. 7,417,203 discloses a sorting device wherein the particles are transported past the measurement region on the inside of a rotating drum furnished on its inside with a large number of pockets. The drum is rotated at such a speed that particles will be held singularly in the pockets by centrifugal forces. The pockets are provided with perforations. A detector measures a property of the particles through these perforations, and particles are sorted into different containers by air pulses. A disadvantage of such a setup is that the range of possible rotational speeds (angular velocities) of the rotating drum is very limited. If the rotational speed is too small, the particles may not be properly held in their pockets during the measurement and sorting process. On the other hand, if the rotational speed is too high, there is a risk of overfilling the pockets with several particles.

U.S. Pat. No. 5,956,413 discloses an apparatus for simultaneously evaluating a plurality of cereal kernels by video imaging. The kernels are transported past a video camera by means of a vibrating conveyor belt having a plurality of transverse grooves. Cereal kernels are spread into these grooves with the aid of a second conveyor belt. For separating kernels from different grooves, it is suggested to cover the grooves of the first belt by a third belt having similar grooves aligned with the grooves of the first belt, so as to form cylindrical channels between the two belts. A compressed-air source is used to blow the kernels of selected channels into a separate container. A disadvantage of this arrangement is that all kernels in a selected channel are blown into the same container, i.e., no individual selection of single kernels is possible.

WO 2006/054154 discloses different embodiments of apparatus for sorting inorganic mineral particles using reflectance spectroscopy. In one embodiment, particles are fed to a longitudinally grooved conveyor belt and transported past a reflectance spectrometer. Based on spectral information obtained from the spectrometer, the mineral particles are classified, and individually identified particles may be picked from the conveyor belt by a single pneumatic mini-cyclone. Due to the presence of only a single means for picking individual particles from the belt, the apparatus is only suitable for picking a relatively small number of particles of interest from a large sample of particles; however, such an apparatus is not well-suited for sorting particles into different quality classes of similar sizes.

From sowing machines it is known to dispense single seeds with the aid of a drum having perforations, to which suction is applied to enable the seeds to be picked up by the drum by vacuum action. Examples of such machines are provided in U.S. Pat. No. 4,026,437, DE 101 40 773, EP 0 598 636, U.S. Pat. No. 5,501,366, and EP 1 704 762. In these machines the seeds are picked up by the drum from a pick-up container or hopper and transported on the external surface of the drum all the way until they are released from the surface in a release region, from where they are deposited in the soil. Release is carried out by blocking the vacuum action by passive mechanical means inside the drum, possibly in combination with a scraper on the outside of the drum. These devices act only as positioning mechanisms, and no analysis or sorting is carried out at all. They are usually installed on agricultural machines such as farm tractors, which proceed at low speed to permit a proper distribution of seeds in the soil.

Martin et al., *Development of a single kernel wheat characterizing system*, Transactions of the ASAE, Vol. 36, pp. 1399-1404 (1993) discloses a method for feeding grains one by one to a subsequent crushing device by means of a rotating drum. The drum has an internal spiral groove which transports the grain to a U-shaped groove at one end of the drum. The U-shaped groove has six pickup holes for holding kernels at the inside of this groove by vacuum action. Kernels held in this manner are transported to an intercepting groove, where they are released and fall down into the crushing device. The drum rotates at a low speed of 30 rpm. The transport capacity is about 2 kernels per second. No sorting is carried out. The mechanical design prevents the system from being scaled up to higher speeds and is therefore unsuitable for rapid sorting applications.

SUMMARY OF THE INVENTION

It is an object of the present invention to provide a sorting apparatus which enables rapid and reliable sorting of individual particles into quality classes of similar analytical properties, which can easily be modified to allow sorting into more than two quality classes, and which offers increased flexibility in the choice of particle throughput and measuring parameters.

The invention provides an apparatus for sorting particles into quality classes, comprising:

- a measurement device for determining at least one analytical property of said particles;
- a transport device for transporting the particles past the measurement device; and
- a sorting device operatively coupled to said measurement device for sorting the particles into at least two quality classes based on said analytical property.

For achieving efficient, rapid and well-defined transport of the particles past the measurement device, the transport device comprises a transport surface configured to move in a transport direction, the transport surface having a plurality of perforations. The transport device further comprises a pump for applying a pressure differential to said perforations at least in a selected region of the transport surface to cause particles fed to said transport device to be aspirated to said perforations and to be transported on said transport surface along the transport direction past the measurement device to the sorting device.

The particles will thus be transported on a first side of the transport surface in well-defined locations defined by the perforations, these perforations generally being smaller than the smallest dimension of the particles so as to avoid that particles pass through the perforations. The pump is preferably a suction pump applying a vacuum below ambient pressure to a space confined by the opposite (second) side of the transport surface so as to aspirate the particles by vacuum action. However, it is also conceivable that the pump applies an overpressure to a space confined by the first side so as to generate an air stream through the perforations from the first side to the second side of the transport surface, which will cause aspiration in an equivalent way as if vacuum were applied to the second side.

The measurement device may include one or more spectrometers, imaging spectrometers, cameras, mass spectrometers, acoustic-tunable filters, etc. to analyze particles like grains, beans, or seeds with respect to their analytical properties. The present apparatus may be able to assess one or several analytical properties simultaneously by measuring spectral properties (i.e., the dependence of certain optical properties like reflectance or transmission on wavelength) of the particles under investigation. Types of particles that can be sorted with such an apparatus and method include, without being limited thereto, agricultural particles such as grains, beans, seeds or kernels of cereals like wheat, barley, oat, rice, corn, or sorghum; soybean, cocoa beans, and coffee beans, and many more. Types of analytical properties that can be assessed are, without being limited thereto, chemical or biochemical properties, the degree of contamination with contaminating agents and/or infective agents and/or other pathogen agents, and/or geometric and sensorial properties such as size, shape, and color. In particular, biochemical properties shall be understood to be properties that reflect the structure, the composition, and the chemical reactions of substances in living organisms. Biochemical properties include, without being limited thereto, protein content, oil content, sugar content, and/or amino acid content, moisture content, polysaccharide content, in particular, starch content or gluten content, fat or oil content, or content in specific biochemical or chemical markers, e.g., markers of chemical degradation, as they are generally known in the art. Contaminating or infecting agents include harmful chemicals and microorganisms, which can cause consumer illness and include, without being limited thereto, fungicides, herbicides, insecticides, pathogen agents, bacteria and fungi.

In a first preferred embodiment, the transport device comprises an endless transport belt (conveyor belt) defining said movable surface, the belt having perforations. The transport device then preferably further comprises a box that is open to its bottom, the bottom of the box being covered by said transport belt, the box being connected to the pump for applying a vacuum to said box. In this manner, a vacuum can be applied to a well-defined region of the transport belt in a very simple way. The box may house at least part of said measurement device and/or of said sorting device. By the way of example, the box may house one or more energy sources like light or sound sources for analyzing the particles, one or more detectors for receiving energy transmitted through and/or reflected or scattered from the particles, and/or one or more actuators such as pneumatic ejection nozzles for selectively ejecting particles from the perforations at defined locations.

In another preferred embodiment, the transport device comprises a rotatable transport drum or wheel having a circumferential surface or generated surface which defines said movable surface. The drum is then preferably connected to the pump for applying a vacuum to the interior of said drum. In particular, the pump can be connected to the interior of the drum through a hollow central axle of the drum. At least part of said measurement device and/or of said sorting device may be disposed inside said drum.

In all embodiments it is preferred if the perforations are arranged in a plurality of parallel rows extending in the transport direction. In this manner, it is possible to move a plurality of particles past said measurement device simultaneously in well-defined locations. The lateral distance between the rows is preferably somewhat larger than the (average) largest dimension of the particles so as to avoid overlap of particles. The perforations of adjacent rows may be arranged in the same position along the transport direction, such that the perforations form a rectangular grid on the transport surface, or they may be arranged in different positions along the transport direction, such that the perforations form an oblique grid or even an irregular arrangement.

The apparatus may be complemented by a feeding device for receiving a bulk of said particles, for singularizing said particles, and for feeding said singularized particles to said transport device. In a preferred embodiment the feeding device comprises an endless feeding belt configured to receive said particles from some storage device such as a hopper, possibly coupled with a singularizing device such as a vibratory stage, and to transport said particles in the transport direction to said transport surface to enable said particles to be aspirated to the perforations of the transport surface. The feeding belt preferably moves in the transport direction at a speed that is lower than but close to the speed of the transport surface, preferably at 50%-100%, in particular, 70%-90% of the speed of the transport surface, so as to optimize aspiration and to minimize acceleration of the particles in the transport direction when the particles are aspirated to the transport surface. This enables the transport surface to move at a higher velocity than in the absence of the feeding belt. The feeding belt may have an outer surface with a plurality of parallel grooves extending in the transport direction, the grooves having a lateral distance corresponding to a lateral distance between the perforations of the transport surface so as to better position the particles below the perforations. The feeding belt may in some embodiments also be perforated in a similar manner as the transport surface, with a pressure differential applied to the feeding belt as well. It is then preferred that the pressure differential applied to the feeding belt is zero or much smaller than the pressure differential applied to the transport surface in that region where the feeding belt overlaps with the transport surface for aspiration of particles from the feeding belt to the transport surface.

A recirculation duct may be provided for transporting particles which have not been aspirated to said transport surface back to said feeding device. The recirculation duct may be coupled to the same pump which also generates the pressure differential of the transport surface.

In preferred embodiments, analysis of the particles is carried out by optical means, and said measurement device comprises at least one light source and at least one light detector. The term "light" is to be understood to encompass all kinds of electromagnetic radiation from the far infrared (IR) region to the extreme ultraviolet (UV) or even to the X-ray region of the electromagnetic spectrum. The light source and light detector may be arranged on different sides of the transport surface, so as to shine light through said perforations, and the light detector may then be arranged to receive light transmitted through particles moved past the measurement device on said transport surface. In other embodiments, the light source and light detector may be arranged on the same side of the transport surface (preferably on that side on which the particles are transported), the light detector being arranged to receive light reflected from particles moved past the measurement device on said transport surface. For increasing the throughput of the apparatus, the measurement device may comprise a plurality of light detectors arranged along a transverse direction extending transverse to the transport direction, so as to enable simultaneous measurements of the analytical properties of particles moving past the measurement device in different transverse locations.

The light detector may comprise at least one spectrometer configured to record spectra of light received from particles moving past the measurement device. These spectra may then be analyzed to derive analytical properties from the spectra. In some embodiments, the light detector may comprise an imaging spectrometer configured to record spatially resolved spectra of particles moving past the measurement device in different transverse locations. In this manner, not only spectral properties of these particles may be analyzed, but also geometric properties such as size or shape may be derived. In other embodiments, the light detector may comprise a camera, in particular, a line-scan camera or a camera having a two-dimensional image sensor. This allows analyzing size and/or shape independently of other properties.

Sorting may be carried out in a variety of different ways, including pneumatic, piezoelectric, mechanic and other types of sorters. For example, the sorting device may comprise at least one pneumatic ejection nozzle operatively coupled to said measurement device to generate an air jet for selectively blowing particles moving past said ejection nozzle away from the transport surface. The ejection nozzle is then preferably positioned at that side of the transport surface that is opposite to the side on which the particles are transported, so as to generate an air jet through said perforations. This enables a very well defined ejection of selected single particles.

The method of sorting particles into quality classes according to the present invention comprises:

transporting the particles past a measurement device;

determining at least one analytical property of said particles by said measurement device; and sorting the particles into at least two quality classes based on said analytical property.

According to the invention, the particles are transported by a transport surface moving in a transport direction, the transport surface having a plurality of perforations, and particles fed to said transport device are aspirated to said perforations and transported on said transport surface along the transport direction past the measurement device.

The analytical property may be determined by one or more of an optical measurement (including X-ray measurements), an acoustic measurement, and a mass spectroscopic measurement. If the measurement is optical, the particles may be illuminated from one side of the transport surface, and light transmitted through said perforations may then be detected on the opposite side of the transport surface. Alternatively the particles may be illuminated from one side of the transport surface, and light reflected or scattered from particles moved past the measurement device on said transport surface may then be detected on the same side of the transport surface. As explained above, analytical properties of a plurality of particles moving past the measurement device may be measured simultaneously. As explained above, the step of determining at least one analytical property may comprise recording spectra of light received from particles moving past the measurement device, in particular, spatially resolved spectra of light received from a plurality of particles moving past the measurement device simultaneously. The step of sorting may involve generating an air jet for selectively blowing particles away from the transport surface, wherein said air jet preferably passes through said perforations to blow particles away from the transport surface. As explained above, particles which have not been aspirated to the transport surface may be recirculated from said transport surface back to a feeding device.

BRIEF DESCRIPTION OF THE DRAWINGS

Preferred embodiments of the invention are described in the following with reference to the drawings, which are for the purpose of illustrating the present preferred embodiments of the invention and not for the purpose of limiting the same. In the drawings.

DESCRIPTION OF PREFERRED EMBODIMENTS

First Embodiment

Figure 1:
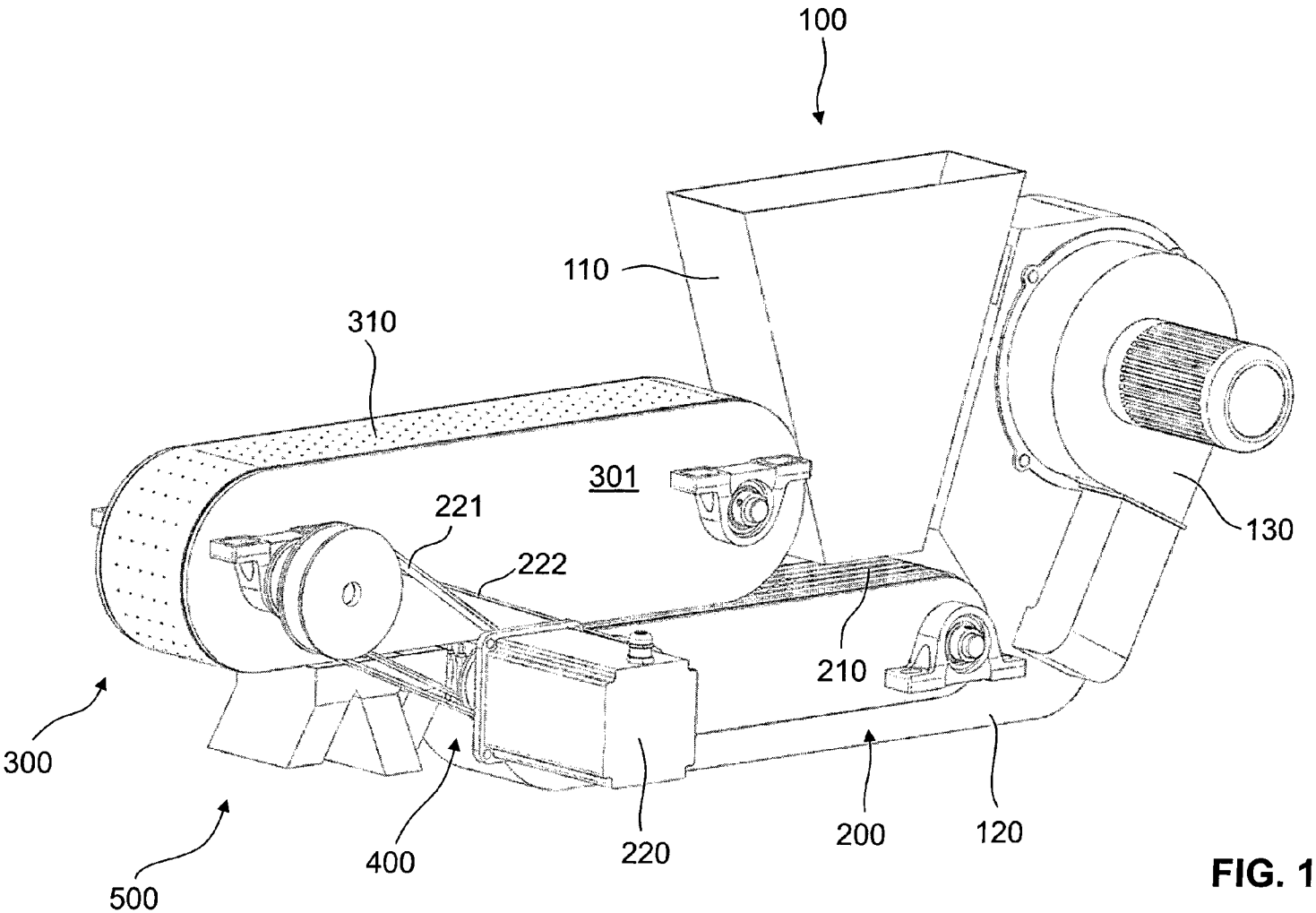
FIG. 1 shows a sorting apparatus according to a first embodiment of the present invention.

A sorting apparatus according to a first embodiment of the present invention is illustrated in FIGS. 1-4. The apparatus comprises a feeding unit 100, an acceleration unit 200, a transport unit 300, a measurement unit 400, and a sorting unit 500. These units are controlled by a common control unit (not shown).

The feeding unit 100 comprises a hopper 110 mounted on a vibratory stage, the hopper acting as a reservoir and as a distribution unit. The hopper is filled with particles, and the vibratory stage, which is activated either manually or automatically, is set such that the number of particles entering the hopper roughly corresponds to the number of particles leaving the hopper for analysis and sorting in a defined time interval. The particles are released from the feeding unit 100 to the acceleration unit 200.

The acceleration unit 200 comprises a first conveyor belt 210 guided by rollers 211 having axles 212, supported by bearings 213, and driven by a motor 220 via drive belts 221, 222. The conveyor belt 210 has a plurality of longitudinal grooves on its outer surface, which are illustrated in more detail in FIG. 6. In the present example these grooves are formed by longitudinal ribs 214 whose lateral distance determines the width of the grooves and roughly corresponds to the lateral dimensions of the particles to be analyzed and sorted. The conveyor belt 210 is positioned below the outlet of the feeding unit 100. It acts to receive particles from the feeding unit 100, to align the particles in singularized form one by one in a plurality of rows, and to accelerate the particles in a transport direction towards the transport unit 300.

Figure 5:
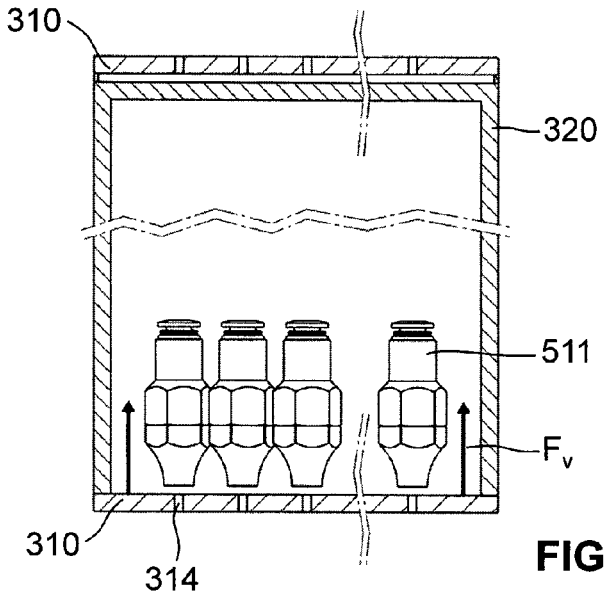
FIG. 5 shows a schematic illustration of the vacuum action on the conveyor belt in the apparatus of FIG. 1.
Figure 6:
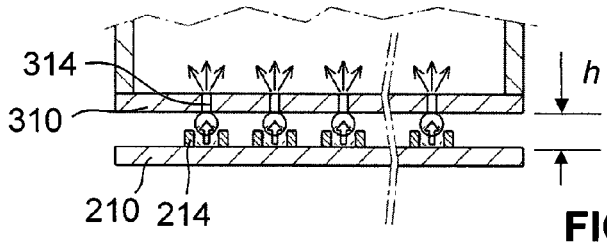
FIG. 6 shows a schematic illustration of the aspiration of the particles to the perforations of the conveyor belt in the apparatus of FIG. 1.
Figure 7:
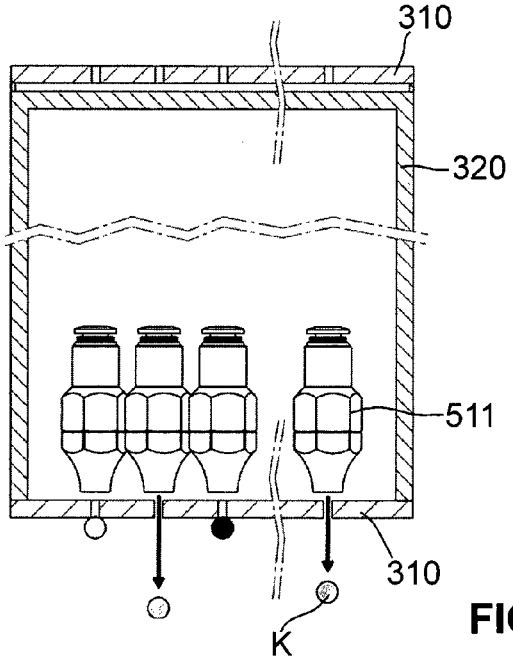
FIG. 7 shows a schematic illustration of the release of selected particles from the conveyor belt in the apparatus of FIG. 1.

The transport unit 300 comprises a second conveyor belt 310 having several parallel, longitudinal rows of perforations (through holes) 314, which are shown in more detail in FIGS. 5-7. The transport unit 300 further comprises a vacuum box 320 which is open towards its bottom; at its bottom the vacuum box 320 is closed by the conveyor belt 310. The box 320 is coupled with an air pump 130 via a vacuum tube 140 (see FIG. 3) to create a reduced pressure relative to the ambient pressure inside the box 320. When the air pump 130 is activated, the conveyor belt 130 is additionally aspirated and pressed against the lower end wall of the vacuum box 320 by a vacuum force $F_v$, thus creating an improved sealing to avoid air losses. This is illustrated schematically in FIG. 5. Air is now sucked into the vacuum box 320 only through the perforations 314 in that region of the conveyor belt 310 that closes off the bottom of the vacuum box. Thereby a suction action is generated at these perforations, which is sufficient to aspirate and hold particles present in the vicinity of the perforations 314.

Figure 2:
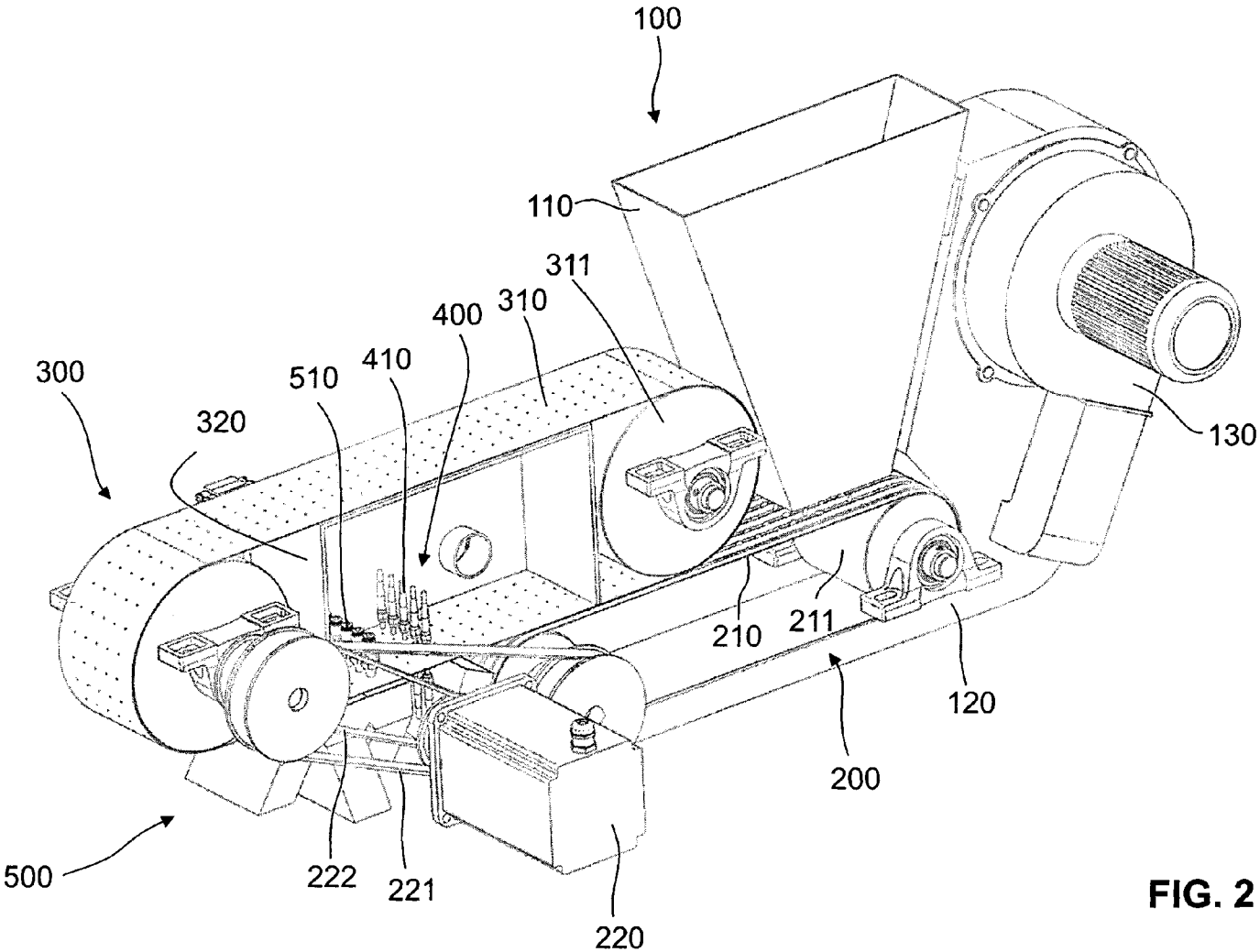
FIG. 2 shows the sorting apparatus of FIG. 1 from the left in a partially opened state.
Figure 3:
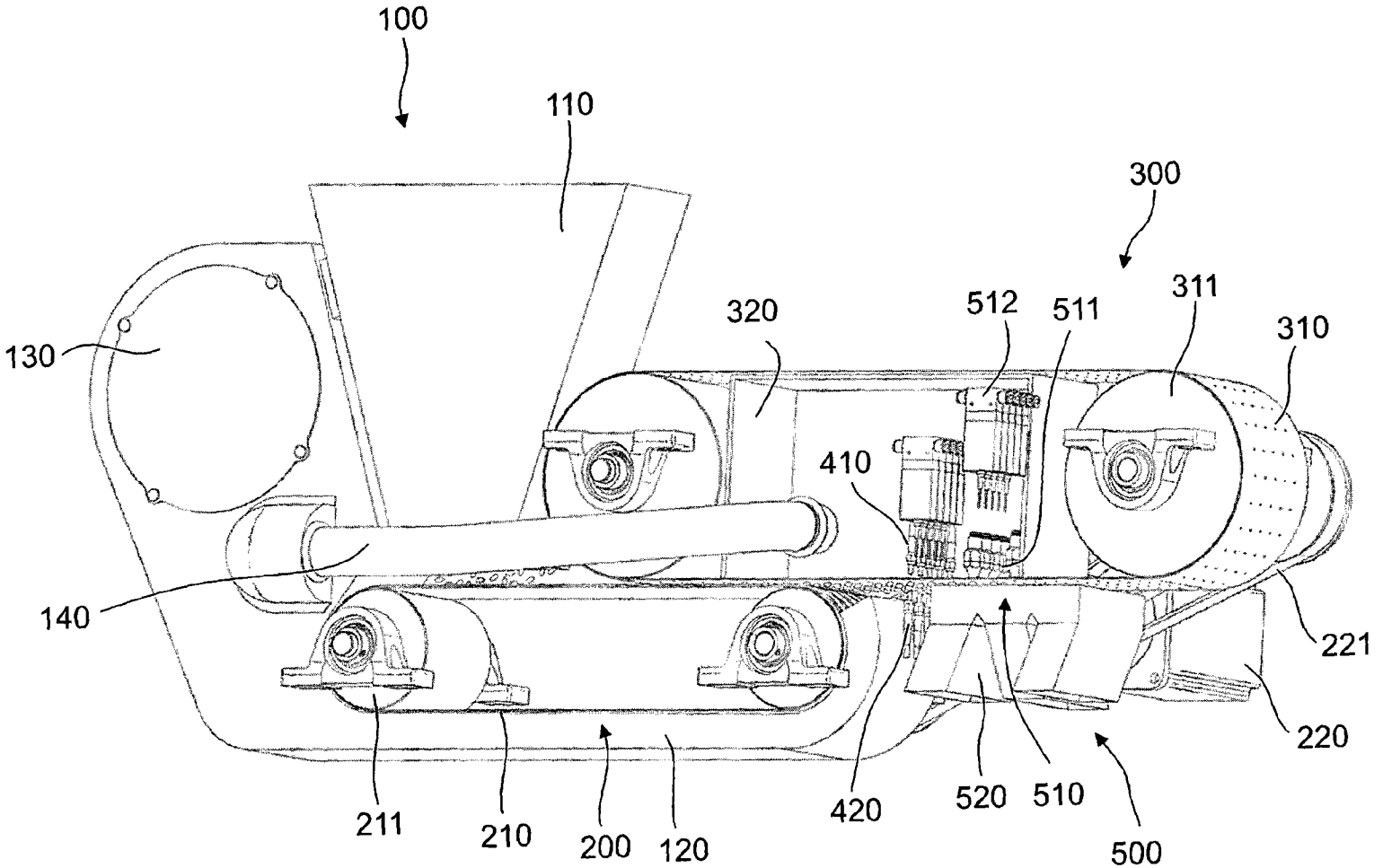
FIG. 3 shows the sorting apparatus of FIG. 1 from the right in a partially opened state.
Figure 4:
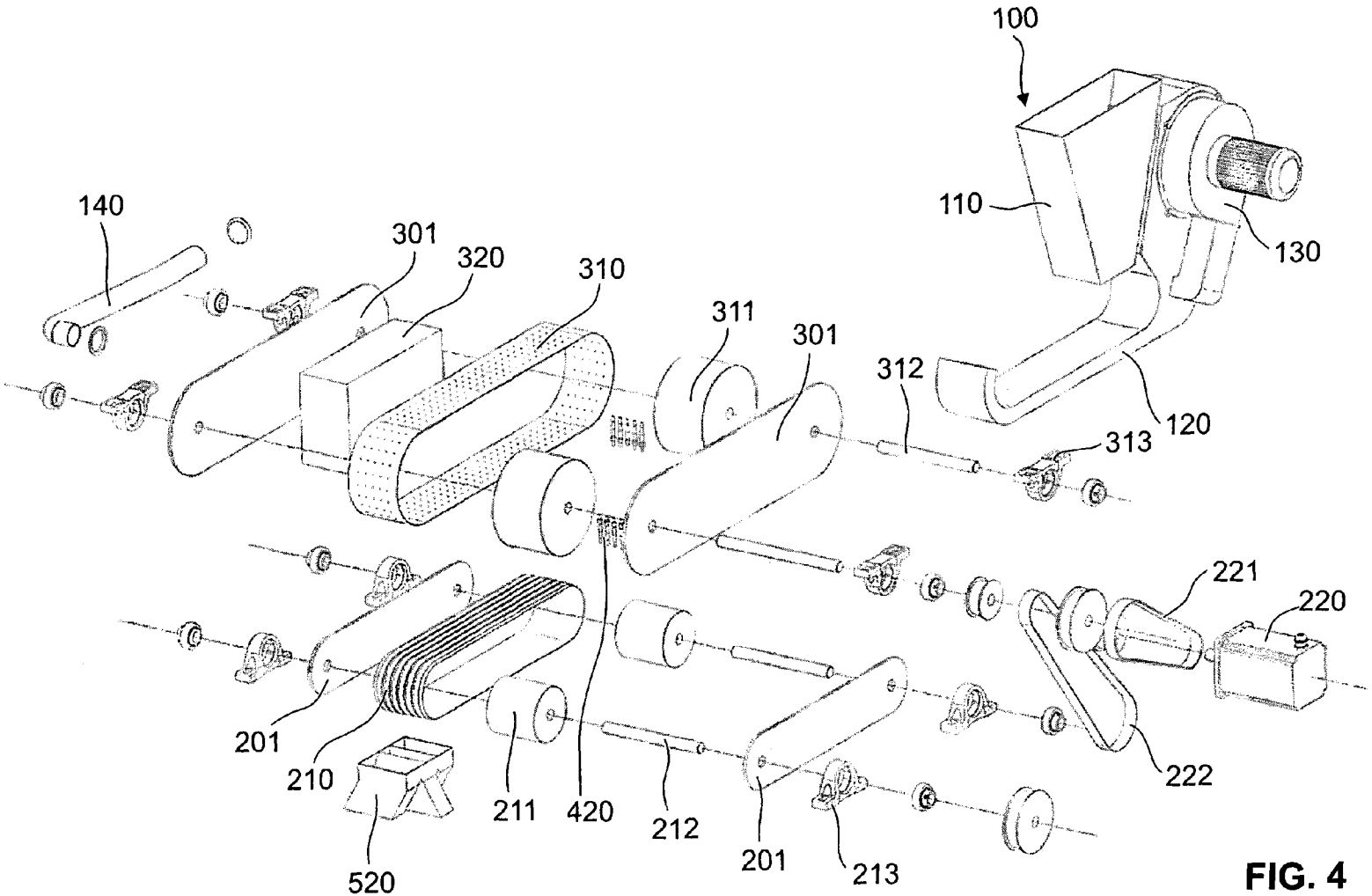
FIG. 4 shows an exploded view of the sorting apparatus of FIG. 1, wherein some components have been left away for better visibility.

The lateral sides of the transport unit 300 are covered by side covers 301, which have been left away to allow a view of the inside of the transport unit in FIGS. 2 and 3. In these Figures, also one of the side walls of the vacuum box has been left away.

The second conveyor belt 310 is placed at a certain vertical distance h above the first conveyor belt 210 and in a downstream position along the transport direction, such that the two belts only partially overlap along the transport direction. The distance h is chosen such that, on the one hand, the particles have enough space to move through between the two belts, and that, on the other hand, particles from the first conveyor belt 210 are aspirated and lifted up to the perforations of the second conveyor belt 310. The vacuum inside the vacuum box 320 now firmly retains a single particle on every perforation 314 on the outside of the second conveyor belt 310.

To ensure that the particles do not interfere with each other, the gaps between the perforations 314 are chosen to be larger than the longest linear dimension of the particles. On the other hand, the gap distance should be chosen as small as possible to achieve a high transporting and/or measurement capacity without increasing the belt speed unnecessarily. The diameter of the perforations 314 should be smaller than the shortest linear dimension of the particles to avoid that the particles can pass through the holes and enter the vacuum box 320.

A similar vacuum system may be optionally employed also for the first conveyor belt 210 in a region where the second conveyor belt receives the particles from the feeding unit 100 to improve singularization of the particles. No vacuum should be active on the first conveyor belt 210 in that region that overlaps with the second conveyor belt 310, so as to avoid interference with the aspiration of particles to the perforations of the second conveyor belt 310.

The linear velocity of the first conveyor belt 210 should be set such that the particles on this conveyor belt are accelerated to a sufficient velocity to allow them to be easily collected by the second conveyor belt 310. Such pre-acceleration of the particles by the first conveyor belt 210 allows using a higher velocity for the second conveyor belt 310 or, in other terms, achieves an increased transporting capacity. The optimal velocity of the first conveyor belt 210 will be very close to the velocity of the second conveyor belt 310. In fact, if the velocity of the first conveyor belt 210 were much smaller than the velocity of the second conveyor belt 310, the particles would have to accelerate almost instantaneously in order to be collected by the second conveyor belt 310, which might cause the particles to fall off from the second conveyor belt 310 or to be collected with a reduced level of efficiency at high velocities.

In this manner particles are collected one by one by the transport unit 300 and transported towards the measurement unit 400. Particles that leave the acceleration unit 200 without having been collected by the transport unit 300 fall down into a recirculation duct 120 and are transported back into the hopper 110 by the pump 130.

The measurement unit 400 generally comprises at least one energy source for exposing a particle under investigation to electromagnetic radiation or sonic waves, and at least one detector arranged to receive electromagnetic radiation or sonic waves from the particle under investigation. In FIGS. 1-4, the energy source is only very schematically symbolized by the ends of a linear array of optical fibers, each fiber ending above one longitudinal row of perforations of the conveyor belt 310, these fibers together representing a generic illumination system 410. The detector is symbolized by a corresponding array of optical fibers for receiving light transmitted though particles held on these perforations, together representing a generic detection system 420.

In a preferred embodiment, the illumination system illuminates the particle with electromagnetic radiation (generally referred to as "light" in the following), and the detection system 420 detects the radiation once it has interacted with the particle. In order to increase the amount of signal detected, focusing, imaging or guiding systems, such as e.g. lenses, mirrors, optical fibers or combinations of these elements, may be used for concentrating the source radiation onto the particle and for collecting the signal emitted, reflected, scattered, or transmitted by the particle toward the detector. Such elements are not shown in the drawing since they are well known in the related optical art.

The measurement unit 400 may provide multivariate measurements in order to assess some specific traits of the particle, such as its biochemical composition or other analytical properties. In a preferred embodiment, a multivariate measurement is obtained by measuring the spectral composition of light once having interacted with the particle under study.

The control unit receives signals from the measurement unit 400 and from these signals determines the quality class to which each of the particles belongs, and sends associated control signals to the sorting unit 500.

The sorting unit 500 comprises an ejection system 510 with ejection nozzles 511 coupled to pneumatic ejection valves 512, and a collector 520 with a plurality of bins, one bin per quality class. For simplicity, all pneumatic tubing has been left away in FIGS. 1-4. For each quality class except one, there is one group of ejection nozzles 511 with associated valves 512. As an example, if the particles are to be sorted into three quality classes, then only two groups of ejection nozzles 511 are employed. The ejection nozzles 511 create an air stream through selected perforations of the second conveyor belt 310 which overcomes the suction force created by the vacuum, so as to make any particles that were held on those perforations fall off the perforation and be collected in the bin corresponding to its quality class. Sorting into the third quality class is then obtained automatically when the particles not yet blown away by any ejection nozzles reach the end of the vacuum box 320, since these particles will now fall off from the second conveyor belt 310 because of the missing suction in this area. Additional passive ejection means can be employed here, such as a scraper or any other means that is able to mechanically remove any remaining particles from the second conveyor belt 310.

Instead of ejection nozzles 511, any other means for selectively removing particles from the second conveyor belt may be used, such as piezoelectric devices, magnetic devices, moving flaps or any other means that can be activated and controlled by a control unit.

The result of the sorting process is to collect the particles in homogeneous batches, starting from an initial heterogeneous batch.

Downstream from the sorting unit, an optional cleaning unit may remove any kind of residual, unwanted material from the transport unit 300, such as dust or small particles, before collecting other particles from the accelerating unit 200. This cleaning unit may be passive or active.

The control unit is used (a) to control the movement of the mechanical parts, (b) to control the vacuum pump, (c) to activate the ejection means, (d) to control the measurement unit for data acquisition, (e) to process the recorded signals and retrieve any calibration information, and (f) to monitor the overall functioning of the sorting device. The control unit may comprise a general-purpose computer, e.g., a standard notebook computer, executing dedicated software for processing the recorded signals and for deriving control signals for the ejection means on the basis of the recorded signals.

Considerations with Respect to Detection

Any suitable light source may be used to provide broadband illumination for the range of wavelengths considered for the multivariate measurement. Preferred light sources are those that can provide light throughout the spectral response used for the multivariate measurement, but several light sources with narrower bands may be combined as an alternative. Examples of such light sources include, but are not limited to, halogen, tungsten halogen, xenon, neon, mercury and LED. In a preferred embodiment, a tungsten halogen light such as a HL-200 source from Ocean Optics Inc. (Ocean Optics Inc., 830 Douglas Ave., Dunedin, Fla. 34698, USA) providing light in the range of 360 to 2000 nanometers is used. This source is used in combination with an optical fiber to guide the illumination light toward the sample.

The multivariate signal coming from the illuminated particle is recorded. For this purpose, the detector may be dedicated to spectroscopic measurement, i.e. the measurement of the light intensity with respect to the wavelength. A person skilled in the art realizes that any apparatus capable of extracting the spectral information from the detected signal may be used. A direct measurement of the light intensity in a specific wavelength range can be carried out by associating a filter to a detector. Examples of such filters include, but are not limited to, absorptive colored filter, dichroic mirror and acousto-optic tunable filter. For more complete multivariate measurement, continuous spectra can be recorded over an adapted spectral range. This can be done for instance with a single detector, e.g. photodiode, paired with an optical cavity of controllable thickness, often known as Fourier-Transform spectrometry. This can also be done by the association of a detector composed of several sub-units, or pixels, and of a dispersive element such as a prism or a diffraction grating, that spatially separate the different wavelengths composing the signal onto the pixels of the detector, often known as dispersive spectrograph. Furthermore, a dispersive spectrograph may use a single row of pixels to provide one spectrum, but it may as well simultaneously monitor several spectra by the use of an imaging conjugation and a two dimensional array of pixels. The latter configuration is often called an "imaging spectrometer".

The source and detector may be positioned on the same side or on the opposite sides of the second conveyor belt 310. In the following, light received from a particle along a direction that is in the half-space opposite to the direction of illumination is referred to as "reflected light", regardless of whether it is reflected by direct or diffuse reflection, by fluorescence etc. Light received from the sample in the half-space containing the direction of illumination is referred to as "transmitted light", regardless of whether it is directly transmitted or scattered. These definitions of the reflected and transmitted light are intended to take into account the diffuse reflectance and transmittance that may be detected at various angles around the particle. The two main configurations considered here then may be called "reflection mode" and "transmission mode" configurations. In a "reflection mode" configuration both the source and the detector are on the same side of the second conveyor belt 310, in order to collect the radiations emitted, scattered, and reflected by the particle backward with respect to the direction of propagation of the illumination. In a "transmission mode" configuration the source is located on one side of the second conveyor belt 310 while the detector is on the other side of the second conveyor belt 310. The radiations emitted, scattered, transmitted by the particle is detected forward with respect to the direction of propagation of the illumination.

FIGS. 8-17 illustrate possible arrangements of light source and detector in such configurations.

Figure 8:
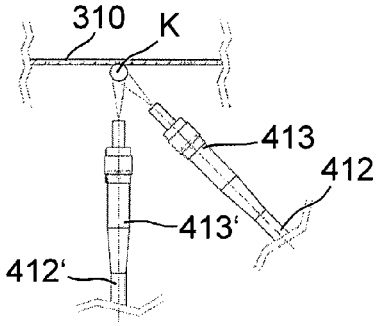
FIG. 8 shows a schematic illustration of a first exemplary arrangement of a light source and a detector for measurements in reflection mode.

FIG. 8 shows a "reflection mode" configuration wherein light reflected from the particle K under investigation is detected at an angle to the illumination axis. A first fiber 412 connected to a light source ends at a fiber end 413 pointing toward the particle K. A second fiber 412' connected to the detector ends at a fiber end 413' pointing toward the particle K so as to overlap the respective fields of view of the two fibers on the particle; the second fiber is oriented at a non-zero angle with respect to the first fiber. This configuration is especially well suited to collect diffusely reflected light.

Figure 9:
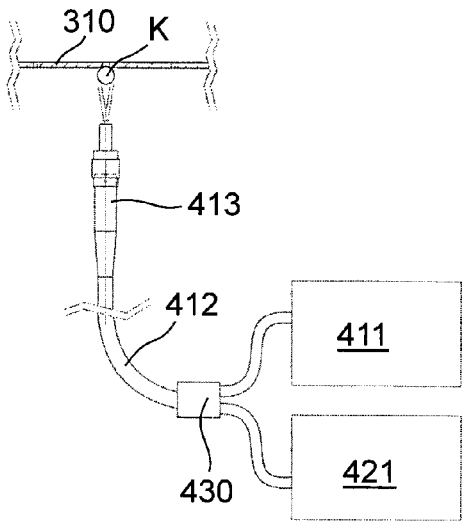
FIG. 9 shows a schematic illustration of a second exemplary arrangement of a light source and a detector for measurements in reflection mode.

FIG. 9 illustrates an arrangement where a single fiber is used for illumination and detection. The fiber is bifurcated in a combiner/splitter 430, one part of the fiber being connected to a light source 411 and the other part being connected to a detector 421. In an alternative configuration, two single fibers ending side by side may be used instead of a bifurcated fiber.

Figure 10:
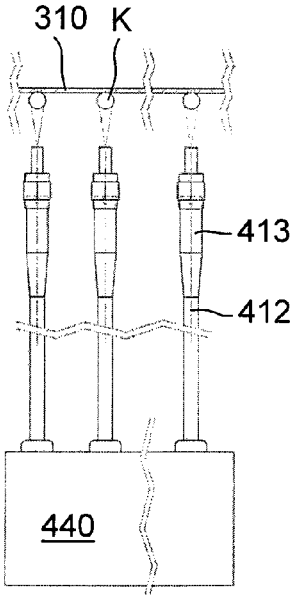
FIG. 10 shows a schematic illustration of multiple measurements in reflection mode with multiple fibers.

FIG. 10 illustrates how multiple measurements can be carried out with several fibers from a single source/detector unit 440.

Figure 11:
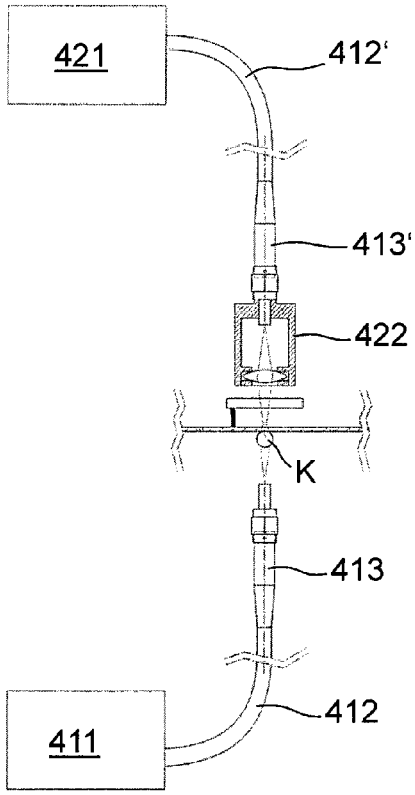
FIG. 11 shows a sketch of an arrangement of a light source and a detector for measurements in transmission mode.

FIG. 11 illustrates a "transmission mode" configuration, wherein light is transmitted from a light source 411 through the particle K and through the perforation of the conveyor belt, collected by a focusing unit 422 and transmitted through a fiber 412' to a detector 412.

Figure 12:
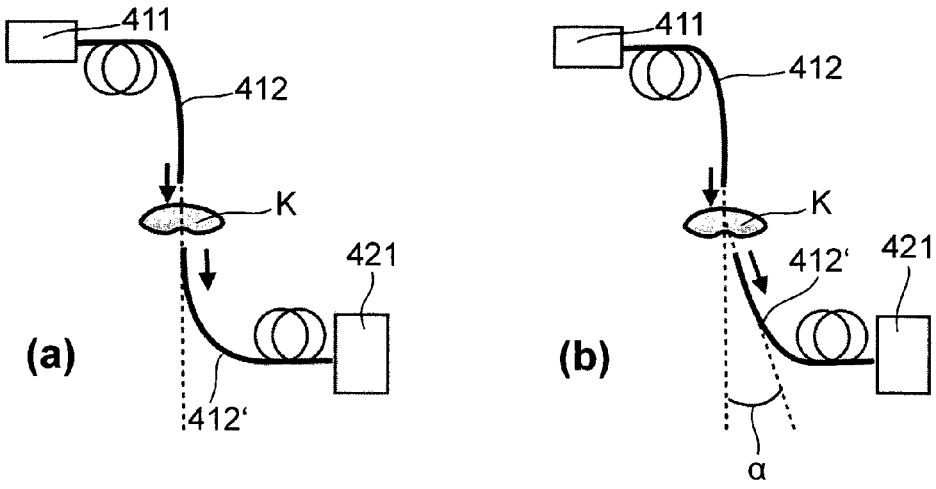
FIG. 12 shows a sketch of two different possible alignments of illumination and detection fibers in an arrangement for measurements in transmission mode.

FIG. 12 illustrates in part (a) a "transmission mode" configuration wherein the fiber for illumination and the fiber for detection are arranged coaxially; in part (b) an alternative configuration is illustrated where these two fibers are arranged at an angle $\alpha$. The latter arrangement is particularly suited for detecting diffusely scattered light.

Figure 13:
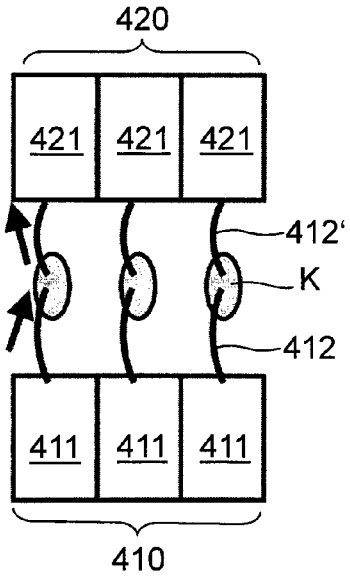
FIG. 13 shows a sketch of an arrangement of multiple subunits for multiple measurements in transmission mode.
Figure 14:
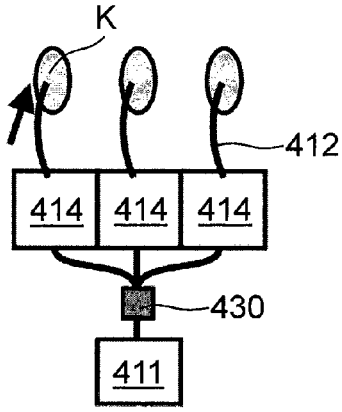
FIG. 14 shows a sketch of an alternative arrangement of multiple subunits for multiple measurements in transmission mode, using a multi-furcated optical fiber.

FIG. 13 illustrates that illumination may be carried out by several independent light sources 411, together forming an illumination system 410, and detection may be carried out by several independent detectors 421, together forming a detection system 420. As illustrated in FIG. 14, in an alternative configuration a single light source 411 may illuminate a plurality of particles K via a bundle of fibers or via a splitter 430 so as to form a plurality of sub-sources 414. Alternatively, a continuous illumination area can be formed, covering the area where the particles are detected.

Figure 15:
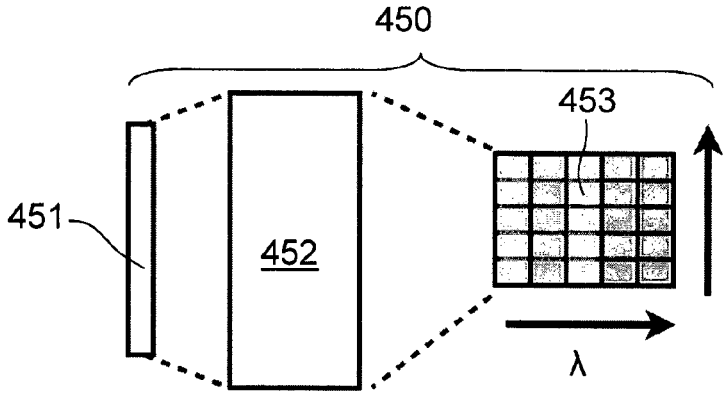
FIG. 15 shows a sketch illustrating the operating principle of an imaging spectrometer.
Figure 16:
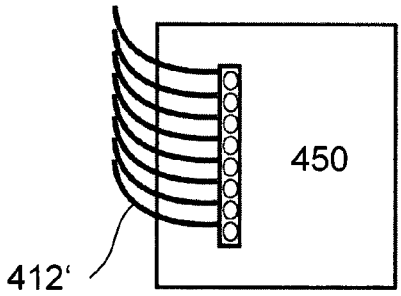
FIG. 16 shows a sketch illustrating the use of an imaging spectrometer with multiple fibers.
Figure 17:
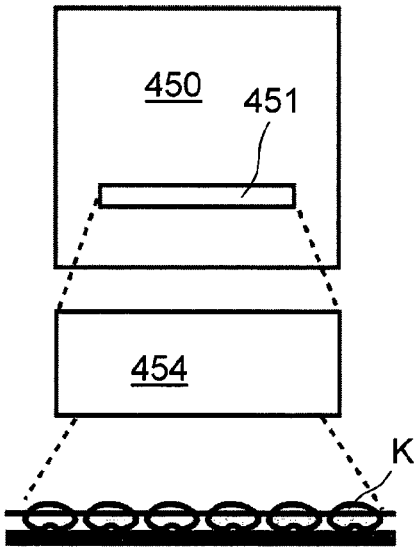
FIG. 17 shows a sketch illustrating a simultaneous detection of a plurality of particles by an imaging spectrometer.

FIGS. 15-17 illustrate the use of an imaging spectrometer 450. The imaging spectrometer 450 comprises an entrance slit 451, a 2D array 453 of light sensitive pixels and an optical unit 452 including the combination of a dispersive element and an imaging system. The spectral composition of the light entering the slit is recorded along one direction of the array (symbolized by wavelength $\lambda$) while the other direction corresponds to the image of the entrance slit.

With such an arrangement, multipoint spectral measurements may be carried out by providing a single spectrum detector for each point of interest, or an imaging spectrometer may be used for multipoint spectral measurement with a single spectroscopic device. An imaging spectrometer can be also used to collect spatial information on the particles that, coupled with the recorded spectral information, allows the collection of several measurements points for each particle.

Multi-point measurements may be carried out with an imaging spectrometer paired with a collecting fiber bundle (FIG. 16). The fibers 412' for collecting the light from the sample are assembled in a linear bundle and presented at the entrance slit of the imaging spectrometer. Each fiber is imaged on the 2D detector array at a distinct location along one direction. The other direction is used to record the light spectrum. Therefore, the imaging spectrometer provides a measurement of the spectral composition of the light corresponding to each fiber output.

The imaging measurement may be carried out with an imaging spectrometer paired with an external optical imaging system (FIG. 17). This optical imaging system 454 provides an image conjugation between the entrance slit of the imaging spectrometer and a detection line at the surface of the sampling unit. The particles carried by the sampling unit are moving in the perpendicular direction with respect to this detection line. While the particles are passing through the detection line, the imaging spectrometer is taking a succession of spectral images. This technique, commonly known as line scanning imaging, allows reconstructing a spectral image of the particle, i.e. a morphological image of the particles with respect to its spectral content.

Regardless of the type of illumination and detection used, the values recorded by the detector are used by the control unit to derive at least one analytical property for each particle. The control unit uses the measured properties to take a decision on which quality class each particle belongs to.

Second Embodiment

Figure 18:
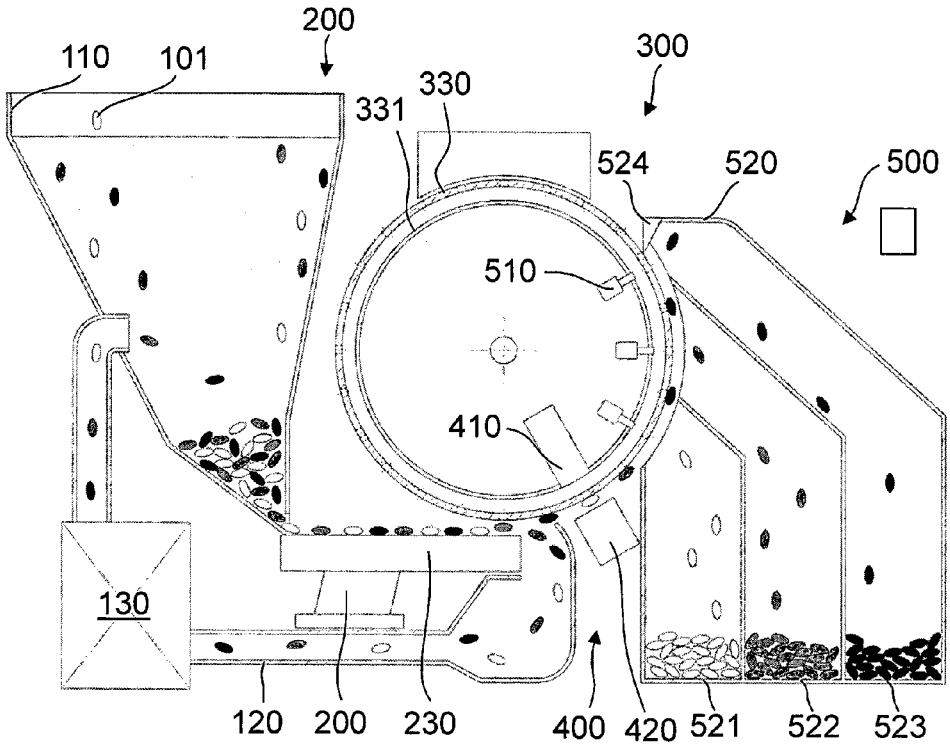
FIG. 18 shows a sorting apparatus according to a second embodiment of the present invention.

A second embodiment of the present invention is illustrated in FIG. 18. Like components as in the first embodiment carry the same reference numerals and are not described again. In the second embodiment, a wheel 330 having a perforated generated surface is used instead of the second conveyor belt 310. Feeding is accomplished by a vibratory stage 230 instead of the first conveyor belt 210; however, it is equally well possible to employ the wheel 330 in conjunction with the first conveyor belt 210, or to employ the second conveyor belt 310 in conjunction with the vibratory stage 230.

Both sides of the wheel 330 are sealed and a vacuum is created inside of the wheel by means of a vacuum pump, e.g., as described in U.S. Pat. No. 4,026,437. This configuration creates an air-suction through the perforations on the generated surface of the wheel, strong enough to catch the particles and firmly hold them in position. The particles, placed in rows and accelerated by the vibratory stage 230, reach the rotating wheel 330. The perforations on the surface of the wheel 330 may be arranged in parallel rows, however other configurations are possible. Because of the air suction and because of the small dimension of the perforations, one particle at a time is caught by each perforation of the wheel and held in position during the spinning of the wheel. The orientation of the particles as shown in FIG. 18 may not necessarily correspond to reality; particles are shown just schematically to illustrate how transport and sorting are carried out. In some embodiments a positioning means (not shown), such as a comb-shaped plate or an air flow or other means, may help the grain positioning and avoids that more than one grain is caught in each perforation.

A fixed inner wheel 331 arranged concentrically inside the wheel 330 carries parts of the measurement unit 400 (here symbolized by the light source) and the ejection system 510. Particles are sorted into three bins 521, 522, 523. A skimmer 524 ensures that all remaining particles that have not reached bins 521 or 522 are moved into bin 523.

Only the space between the outer wheel 330 and the inner wheel 331 needs to be subjected to vacuum in the present embodiment. However, it is equally well possible to subject the complete interior of the wheel to vacuum, and to mount the parts of the measurement and sorting units inside the wheel 330 on any other structure than the inner wheel 331.

While in the present example the rotational axis of the wheel 330 is oriented horizontally, the rotational axis may have any orientation in three dimensional space. A suitable motor or any other type of mechanism that generates rotation is used to move the wheel.

The same considerations for the measurement unit, for the sorting unit, and for the control unit as in the first embodiment also apply for the second embodiment.

Further Embodiments

In further alternative embodiments, acceleration of the particles can be achieved by a conduction system where particles are transported by an airflow. A person skilled in the art will realize that any apparatus that can accelerate, transport and singularize particles at high speeds may be used as an acceleration unit.

EXAMPLE 1

Protein in Wheat

Protein content is one of the primary quality parameters when handling wheat. In the prior art the protein content is normally determined by taking a sample of 3 to 5 dl and analyzing this sample by near-infrared spectroscopy NIRS. The result is an average protein content for the kernels in the sample. Significant sampling errors can arise when a sub-sample is used to determine the protein content of a whole lot. Errors can be reduced by analyzing single kernels and the full value of the lot can be realized when the grains are further processed.

The protein content in wheat kernels has been found to vary significantly from field to field, from cultivar to cultivar and within the same head of the wheat plant. It is very well known in the literature that the difference in protein content between two kernels can be several percentage points.

Three samples of approximately 3 dl were taken from a 10 kg batch of grain. Each sample was measured on a prior art NIR whole kernel analyzer. The results were: 12.3%, 12.4% and 13.1% protein content. The variation in these results is a consequence of the distributional heterogeneity of the batch, meaning different parts of the batch have different protein content.

Figure 19:
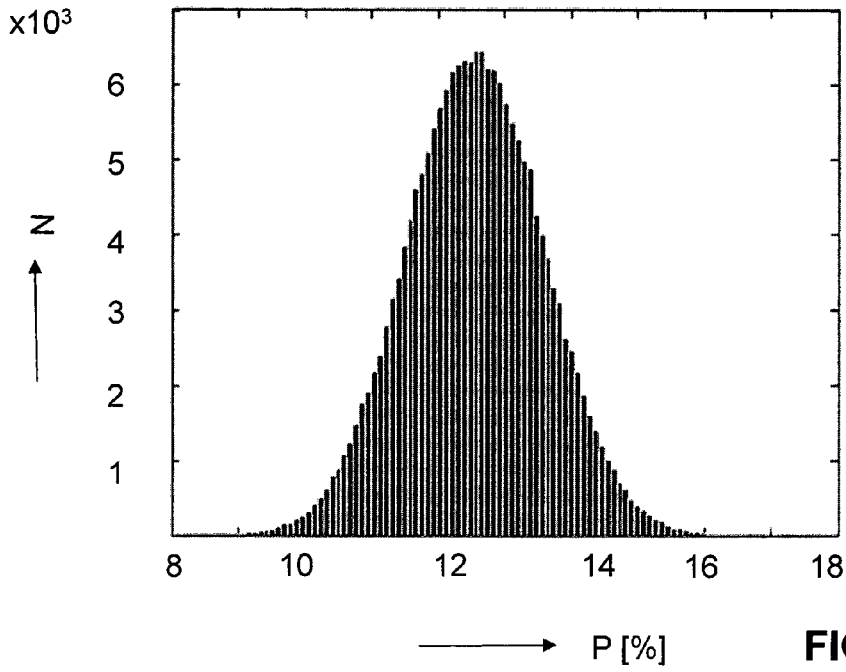
FIG. 19 shows a diagram illustrating a distribution of protein content determined with the apparatus of FIG. 1.

The batch was hereafter analyzed and sorted on single kernel level with a device according to the first embodiment of the present invention. The total number N of kernels was 186282. The measured distribution of protein content P [%] in the kernels is shown in FIG. 19. The mean concentration was P=12.6%.

Figure 20:
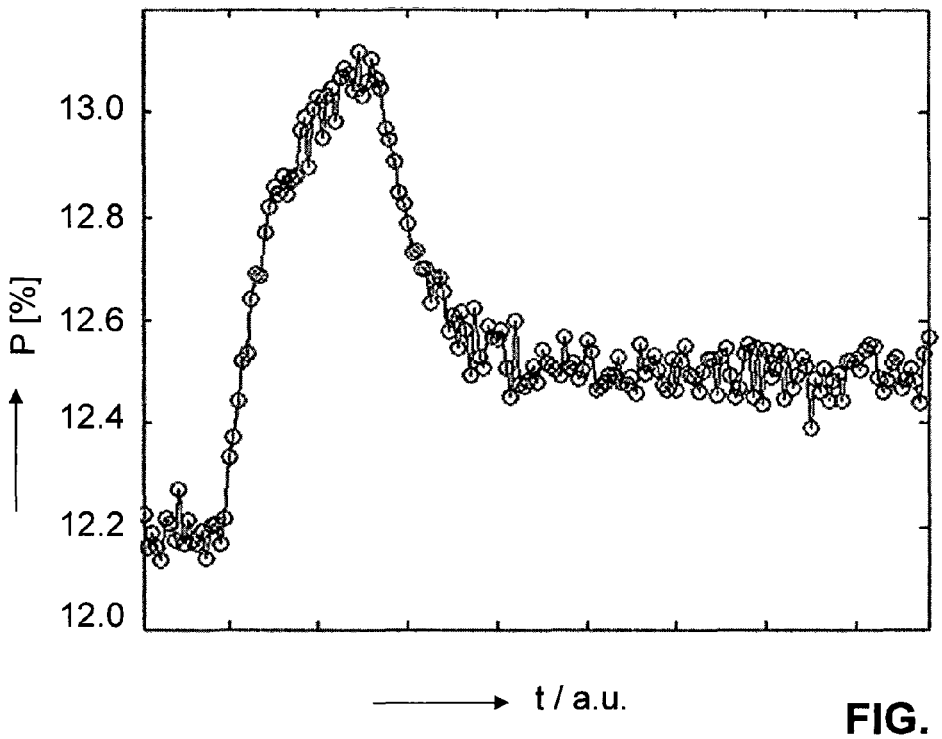
FIG. 20 shows a diagram illustrating the variation of protein content over time.

When the individual kernel measurements (P[%]) are plotted over time (t/a.u.) as in FIG. 20 it is seen that the batch is made up of distinct groups of grain. This could be due to physical modification e.g. segregation during transportation. It could also be that the 10 kg batch has been made up by combining batches of grain of different varieties, from different fields etc. The grain is heterogeneous and the batch has substantial distributional heterogeneity, meaning that the protein concentration differs, on an average level, in different places in the batch. This was what was observed when analyzing the batch with the NIR analyzer. Measurements made on sub-samples have associated sampling errors, arising from the heterogeneity among single kernels. Sampling errors are eliminated when analyzing all single kernels.

Thresholds of 10.0% and 13.0% protein were used for sorting. All kernels below 10% were sorted in class 1, kernels above 10% but below 13% were sorted in class 2 and kernels above 13% protein were sorted in class 3. Table 1 provides the distributions of kernels in the three classes shown together with the average protein content.

TABLE 1

Distribution of kernels in class 1, 2 and 3 after sorting. Thresholds were set at 10% and 13%.

| | Protein content [%] | N° kernels | % kernels of total |
|---|---|---|---|
| Class 1 | 9.7 | 1218 | 0.7 |
| Class 2 | 12.0 | 122242 | 65.6 |
| Class 3 | 13.7 | 62822 | 33.7 |
| Mean of all kernels | 12.6 | 186282 | 100 |

The average protein content is distinct in each of the three classes and one third of the batch has a very high protein content, which can be used for high value products.

Thus, wheat batches or continuous streams of wheat can be analyzed and sorted on single kernel level and a clear picture of the heterogeneity of the grains can be visualized, sampling errors can be eliminated and the kernels can be sorted into classes with distinct biochemical properties which can be used for different purposes, like pasta, wheat beer and bread.

EXAMPLE 2

Insect Infestation in Corn

Fungal contamination and insect infestation can be costly due to post-harvest degradation of stored grain and the risk of having grain downgraded. Analyzing and sorting grain on single kernel level can remove infested kernels and ensure storage stability and consistent quality. In this example, it is demonstrated how a batch of corn can be cleaned from infected kernels using the present invention. Insect and fungal infestation in stored corn batches can decrease the value significantly due to post-harvest loss or downgrading. Infestation is likely to be distributed unequally throughout a batch and therefore there is a high risk of not being detected.

A batch of corn (approximately 1 kg), guaranteed to be free from infestation, was mixed with 100 kernels, guaranteed to be infested with maize weevils. The kernels were thoroughly mixed before further processing. The kernels were analyzed and sorted using the present invention on a single kernel level (in total 2866 kernels). A classification algorithm classified the kernels according to infestation. The kernels identified to be infested were removed in the sorting process. The resulting two fractions of kernels consisted of the infested and the non-infested kernels. Table 2 shows the result of the classification.

TABLE 2

Classification result of classifying 2866 corn kernels according to insect infestation. 100 kernels were known to be infested, of these are 98 kernels identified as infested and 2 kernels are not identified. 2766 kernels were not infested, 89 of these kernels were identified as infested.

| | | Classification | |
|---|---|---|---|
| | | Non-infested | Infested |
| Reference | Non-infested | 2677 | 89 |
| | Infested | 2 | 98 |

Almost all infested kernels are identified and removed from the batch thereby decreasing the possibility of post-harvest degradation and downgrading with economic loss as a result.

EXAMPLE 3

Increasing Starch Content in Corn Through Breeding

Corn is an important crop for biofuel. The starch can be fermented to ethanol, which is used as biofuel. Selecting seed grains based on the starch content can improve the efficiency of breeding to create high yielding cultivars. The corn kernel must be analyzed in transmission to get reliable results of the total oil content. Transmission measurements can only be done using long integration times. In this example it is demonstrated how the current invention can be used to determine the starch content in corn and selecting a fraction of the total kernels for further work.

Corn seeds can be used for the production of biofuel, where the starch is fermented to ethanol and used as biofuel. The corn cultivars used for biofuel production are the results of long and complex breeding programs. Selecting seeds with high starch content can potentially improve efficiency of the breeding programs. Starch content in kernels can range from approximately 30 to 70%. Therefore, analyzing corn kernels individually and in non-destructive way can help in segregating kernels with high starch content, which are better for the production of biofuel.

A 1 kg batch of corn kernels was analyzed for starch and sorted according to the content. The threshold was set at 60%. Throughput was not important in this application, so the kernels were analyzed in transmission mode, which needs longer integration times than in reflection mode. The present invention is designed to be able to operate with wide ranges of integration times.

Figure 21:
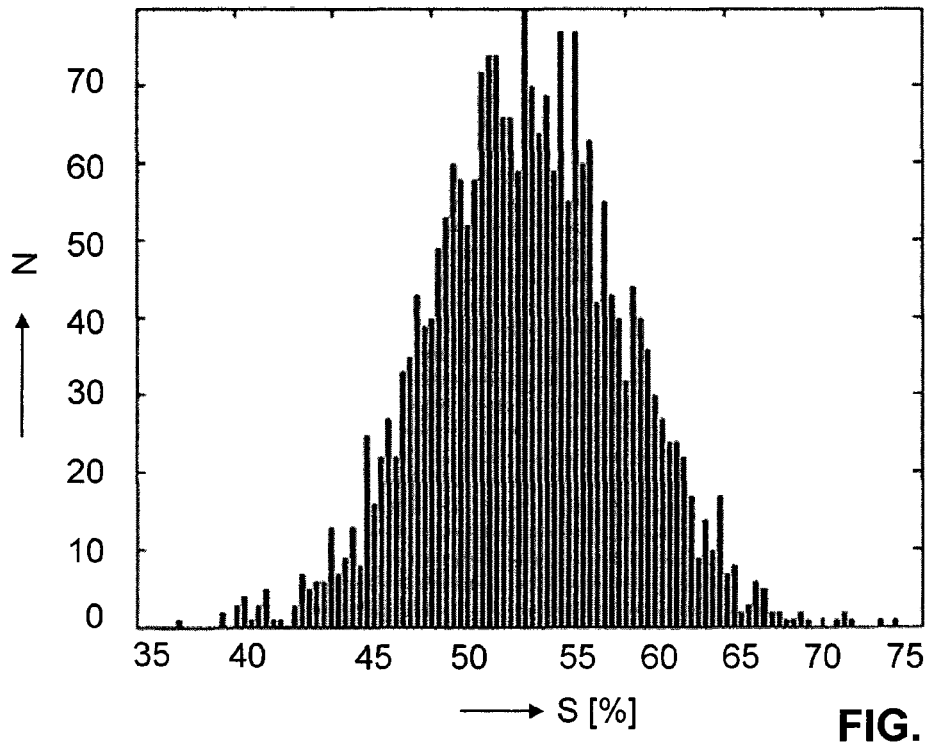
FIG. 21 shows a diagram illustrating a distribution of starch content determined with the apparatus of FIG. 1.

FIG. 21 shows the distribution of kernels (number of kernels N) in the batch. The distribution of starch content S [%] follows a normal distribution.

The kernels with starch content above 60% were selected for further work. Starch content was used in this example, but other properties, which are not directly related to composition, can also be measured and sorted for.

Further Considerations

Figure 22:
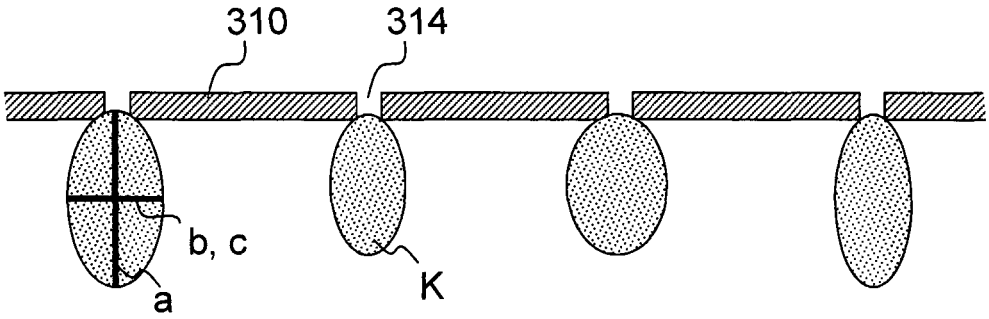
FIG. 22 shows a sketch illustrating the preferred orientation adopted by seeds during transport on the transport surface.

FIG. 22 illustrates particles having a generally oblong ellipsoidal or ovoid shape, with long polar axis a and short equatorial axes b and c, while being transported by a perforated conveyor belt 310. Here, a>b and a>c, while b and c are generally similar in magnitude. Many agricultural particles, in particular grains and seeds, have a shape which can be well approximated by this generally ellipsoidal shape. It has been found in experiments that such particles generally adopt an orientation on the perforations 314 which is similar to the orientation shown in FIG. 22, i.e., the long axis is oriented generally perpendicular to the transport surface. The transport device thus acts to transport the particles not only in well-defined locations (defined by the locations of the perforations 314), but also to induce a well-defined orientation of the particles.

The particles are thus transported past the measurement device in a well-defined orientation, their long axis being perpendicular to the transport surface. This is especially advantageous if size or shape of the particles are to be determined as an analytical property. In particular, data analysis for determining particle size or shape from images recorded by a camera is much simplified if the orientation of the particles is known. In some embodiments, a line-scan camera having a sensor which defines a row of pixels may be employed, the row being parallel to the long axis of the particles (i.e., being perpendicular to the transport surface). Particle size may then be determined simply by counting the number of pixels containing image information from the particles.

The invention claimed is:

1. An apparatus for sorting particles into quality classes, comprising:

a measurement device for determining at least one analytical property of said particles;

a transport device comprising an endless transport belt defining a transport surface configured to move in a transport direction for transporting the particles past the measurement device, the transport surface having a plurality of perforations;

a box having an opening that is covered by said transport belt;

a pump connected to said box to apply a vacuum to said box, for applying a pressure differential to said perforations to cause particles fed to said transport device to be aspirated to said perforations and to be transported on said transport surface along the transport direction past the measurement device; and a sorting device operatively coupled to said measurement device for sorting the particles into at least two quality classes based on said analytical property, wherein at least part of at least one of said measurement device and said sorting device is disposed inside said box.

2. The apparatus of claim 1, wherein the box is open to its bottom, the bottom of the box being covered by said transport belt.

3. The apparatus of claim 1, wherein the perforations are arranged in a plurality of parallel rows extending in the transport direction.

4. The apparatus of claim 1, further comprising a feeding device for receiving a bulk of said particles, for singularizing said particles, and for feeding said singularized particles to said transport device.

5. The apparatus of claim 4, wherein said feeding device comprises an endless feeding belt configured to receive said particles and to transport said particles in the transport direction to said transport surface to enable said particles to be aspirated to the perforations of the transport surface.

6. The apparatus of claim 5, wherein said feeding belt has an outer surface with a plurality of parallel grooves extending in the transport direction, the grooves having a lateral distance corresponding to a lateral distance between the perforations of the transport surface.

7. The apparatus of claim 4, further comprising a recirculation duct for transporting particles which have not been aspirated to said transport surface back to said feeding device.

8. The apparatus of claim 1, wherein said measurement device comprises at least one light source and at least one light detector.

9. The apparatus of claim 8, wherein the light source and light detector are arranged on different sides of the transport surface, so as to shine light through said perforations, the light detector being arranged to receive light transmitted through particles moved past the measurement device on said transport surface.

10. The apparatus of claim 8, wherein the light source and light detector are arranged on the same side of the transport surface, the light detector being arranged to receive light reflected from particles moved past the measurement device on said transport surface.

11. The apparatus of claim 8, wherein the measurement device comprises a plurality of light detectors arranged along a transverse direction extending transverse to the transport direction, so as to enable simultaneous measurements of the analytical properties of particles moving past the measurement device in different transverse locations.

12. The apparatus of claim 8, wherein said light detector comprises at least one spectrometer configured to record spectra of light received from particles moving past the measurement device.

13. The apparatus of claim 8, wherein the light detector comprises an imaging spectrometer configured to record spatially resolved spectra of particles moving past the measurement device.

14. The apparatus of claim 1, wherein said at least one analytical property includes at least one of the following properties:

chemical properties;

biochemical properties; and/or a measure of contamination with at least one contaminating agent, infective agent and/or other pathogen agent.

15. The apparatus of claim 1, wherein the sorting device comprises at least one pneumatic ejection nozzle operatively coupled to said measurement device to generate an air jet for selectively blowing particles moving past said ejection nozzle away from the transport surface.

16. The apparatus of claim 15, wherein the transport device is configured to aspirate the particles to the perforations on a first side of said transport surface, and wherein said ejection nozzle is positioned at a second, opposite side of the transport surface so as to generate an air jet through said perforations.

17. A method of sorting particles into quality classes, comprising:

feeding particles to a transport surface that moves in a transport direction and has a plurality of perforations;

aspirating particles that have been fed to the transport surface to said perforations;

transporting the aspirated particles past a measurement device by the transport surface moving in the transport direction;

determining at least one analytical property of said particles by said measurement device, the analytical property being determined by an optical measurement, the particles being illuminated from one side of the transport surface, and light transmitted through said perforations being detected on the opposite side of the transport surface; and sorting the particles into at least two quality classes based on said analytical property.

18. The method of claim 17, wherein analytical properties of a plurality of particles moving past the measurement device are measured simultaneously.

19. The method of claim 17, wherein the step of determining at least one analytical property comprises recording spectra of light received from particles moving past the measurement device.

20. The method of claim 17, wherein the step of determining at least one analytical property comprises recording spatially resolved spectra of light received from a plurality of particles moving past the measurement device simultaneously.

21. The method of claim 17, wherein said at least one analytical property includes at least one of the following properties:

chemical properties;

biochemical properties; and/or a measure of contamination with at least one contaminating agent, infective agent and/or other pathogen agent.

22. The method of claim 17, wherein the step of sorting comprises generating an air jet for selectively blowing particles away from the transport surface.

23. The apparatus of claim 22, wherein said air jet passes through said perforations to blow particles away from the transport surface.

24. The method of claim 17, wherein particles that have not been aspirated to the transport surface are recirculated from said transport surface back to a feeding device.

25. An apparatus for sorting particles into quality classes, comprising:

a measurement device for determining at least one analytical property of said particles, the measurement device comprising at least one light source and at least one light detector;

a transport device comprising a transport surface configured to move in a transport direction for transporting the particles past the measurement device, the transport surface having a plurality of perforations;

a pump for applying a pressure differential to said perforations to cause particles fed to said transport device to be aspirated to said perforations and to be transported on said transport surface along the transport direction past the measurement device; and a sorting device operatively coupled to said measurement device for sorting the particles into at least two quality classes based on said analytical property, wherein the light source and light detector are arranged on different sides of the transport surface, so as to shine light through said perforations, the light detector being arranged to receive light transmitted through particles moved past the measurement device on said transport surface.

26. The apparatus of claim 25, wherein the transport device comprises an endless transport belt defining said transport surface.

27. The apparatus of claim 25, wherein the perforations are arranged in a plurality of parallel rows extending in the transport direction.

28. The apparatus of claim 25, wherein said light detector comprises at least one spectrometer configured to record spectra of light received from particles moving past the measurement device.

29. The apparatus of claim 25, wherein the light detector comprises an imaging spectrometer configured to record spatially resolved spectra of particles moving past the measurement device.

* * * * *